US009956130B2

(12) United States Patent
An et al.

(10) Patent No.: US 9,956,130 B2
(45) Date of Patent: May 1, 2018

(54) UPPER LIMB REHABILITATION ROBOT

(71) Applicant: Daegu Gyeongbuk Institute of Science and Technology, Daegu (KR)

(72) Inventors: Jinung An, Daegu (KR); Yoon Gu Kim, Daegu (KR); Gwang Hee Jang, Daegu (KR); Jung Hyun Choi, Daegu (KR)

(73) Assignee: Daegu Gyeongbuk Institute of Science and Technology, Daegu (KR)

( * ) Notice: Subject to any disclaimer, the term of this patent is extended or adjusted under 35 U.S.C. 154(b) by 786 days.

(21) Appl. No.: 14/558,745

(22) Filed: Dec. 3, 2014

(65) Prior Publication Data

US 2016/0000633 A1 Jan. 7, 2016

(30) Foreign Application Priority Data

Jul. 7, 2014 (KR) ..... 10-2014-0084691

(51) Int. Cl.
*A61H 1/02* (2006.01)

(52) U.S. Cl.
CPC ..... *A61H 1/02* (2013.01); *A61H 1/0277* (2013.01); *A61H 1/0281* (2013.01); *A61H 1/0285* (2013.01); *A61H 2201/1215* (2013.01); *A61H 2201/1635* (2013.01); *A61H 2201/1638* (2013.01); *A61H 2201/1671* (2013.01); *A61H 2201/5007* (2013.01); *A61H 2201/5043* (2013.01); *A61H 2205/06* (2013.01)

(58) Field of Classification Search
CPC ..... A61H 1/02; A61H 1/0285; A61H 1/0281; A61H 1/0277; A61H 2201/1635; A61H 2201/5007; A61H 2201/5043; A61H 2201/1671; A61H 2201/1638; A61H 2201/1215; A61H 2205/06; A61H 1/0274; A61H 2201/0165; A61H 2201/12; A61H 2201/1207; A61H 2201/1253; A61H 2201/1269
See application file for complete search history.

(56) References Cited

U.S. PATENT DOCUMENTS 5,179,939 A * 1/1993 Donovan ..... A61H 1/0281 482/4
5,451,191 A 9/1995 Beenken
5,698,782 A 12/1997 Gledhill
5,755,645 A * 5/1998 Miller ..... A61H 1/0285 482/115

(Continued)

FOREIGN PATENT DOCUMENTS

KR 10-2003-0016941 A 3/2003
KR 20-0362063 Y1 9/2004
KR 10-1237245 B1 2/2013

*Primary Examiner* — Quang D Thanh
(74) *Attorney, Agent, or Firm* — Revolution IP, PLLC

(57) ABSTRACT

There is provided an upper limb rehabilitation robot including: a base frame that has a side to which a connecting support is rotatably laterally connected; a connecting shaft unit that is rotatably disposed at a side of the connecting support; a link unit that has a side coupled to the connecting shaft unit and the other side with an upper limb connector mounted to enable a person who needs rehabilitation to connect an upper limb; an active actuator that rotates a connecting shaft unit; and a manual actuator that generates resistant torque against rotation to the connecting shaft unit.

14 Claims, 4 Drawing Sheets

(56) References Cited

U.S. PATENT DOCUMENTS

| | | | | |
|---|---|---|---|---|
| 6,117,093 | A * | 9/2000 | Carlson | A63B 21/0056 482/4 |
| 2008/0293551 | A1* | 11/2008 | Tong | A61H 1/0237 482/136 |
| 2009/0264799 | A1* | 10/2009 | Bonutti | A61H 1/0237 601/5 |
| 2010/0041529 | A1* | 2/2010 | Weinberg | A61H 1/0285 482/135 |
| 2015/0133828 | A1* | 5/2015 | Hachisuka | A61H 1/0285 601/5 |

* cited by examiner

UPPER LIMB REHABILITATION ROBOT

CROSS-REFERENCE TO RELATED APPLICATIONS

This application claims the priority of Korean Patent Application No. 10-2014-0084691, filed on Jul. 7, 2014, in the Korean Intellectual Property Office, the disclosure of which is incorporated herein by reference.

BACKGROUND OF THE INVENTION

Field of the Invention

The present invention relates to an upper limb rehabilitation robot, and more particularly, to an upper limb rehabilitation robot that allows a patient to exercise for normal life, is easy and simple to control, allows for multipurpose rehabilitation exercise such as horizontal, inclined, and vertical motions, and allows for multifunctional rehabilitation exercise such as resistant, assistant, and active motions.

Description of the Related Art

In general, an upper limb rehabilitation robot is a device using a robot technology for rehabilitation such as recovering and maintaining the motion function of a patient whose the function of an upper limb is damaged or lost.

The upper limb rehabilitation robot is useful for repeating exercise, adjusting the amount and time of exercise, and quantifying whether exercise progresses and proceeds, so it can standardize rehabilitation exercise and reduce physical load on a curer, and accordingly, consumption is increasing both at home and abroad. Further, recently, upper limb rehabilitation robots having various shapes and functions have been used.

However, the upper limb rehabilitation robots of the related art has a limit in that they provides upper limb rehabilitation motions for various types (for example, horizontal, inclined, and vertical motions, and the like) or various functions (for example, active, manual, resistant, and assistant motions, and the like) and most of the robots are expensive because they are imported.

The background art of the present invention has been described in Korean Patent No. 10-1237245 (2013, 2, 18).

SUMMARY OF THE INVENTION

An aspect of the present invention provides an upper limb rehabilitation robot that allows multifunctional and multipurpose upper limb rehabilitation.

According to an aspect of the present invention, there is provided an upper limb rehabilitation robot including: abase frame that has one side to which a connecting support is rotatably laterally connected; a connecting shaft unit that is rotatably disposed at one side of the connecting support; a link unit that has one side coupled to the connecting shaft unit and the other side with an upper limb connector mounted to enable a person who needs rehabilitation to connect an upper limb; an active actuator that is disposed at a side of the connecting support, connected with the connecting shaft unit, and rotates the connecting shaft unit; and a manual actuator that is connected to the connecting shaft unit and generates resistant torque against rotation of the connecting shaft unit.

The connecting shaft unit may include: a shaft body that has a rod shape and is rotatably longitudinally disposed on the connecting support; and rotary connecting members that are coupled to a side of the shaft body, connected with the active actuator, and receive torque from the active actuator.

The link unit may include: a first rod fixed to the connecting shaft unit; a second rod with an end rotatably coupled to the connecting shaft unit; a third rod with a side rotatably coupled to the other side of the first rod by a pin; and a fourth rod with both ends rotatably coupled to the other end of the second rod and the other end of the third rod by a pin, respectively, and the upper limb connector is coupled to the joint of the third rod and the fourth rod.

The link unit further may have a ball plunger supporting the other side of the link unit and the ball plunger may be coupled to the joint of the third rod and the fourth rod.

The active actuator may include: a driving motor coupled to a side of the connecting support; and a transmitting member coupled to a driving shaft of the driving motor, connected with the connecting shaft unit, and transmitting torque generated by the driving motor to the connecting shaft unit.

The manual actuator may be a variable damper that is disposed on the connecting support, with a shank inserted in the connecting shaft unit, and generates resistant torque against torque of the connecting shaft unit by adjusting a damper value in accordance with an input voltage.

A positioning motor connected with the connecting support and generating torque to rotate the connecting support may be further coupled to the base frame.

The upper limp rehabilitation robot may further include a lifter moving up/down the base frame.

The lifter may include: a support frame; a lifting guide bar that is disposed vertically on the support frame, slides up/down, and has a side connected with the base frame; and a lifting unit that is disposed on the support frame, connected with the lifting guide bar, and generates a driving force for moving up/down the lifting guide bar on the support frame.

A calculating unit and a driving control unit that are electrically connected with the active actuator and the manual actuator may be disposed on the support frame.

A display unit electrically connected with the calculating unit and receiving and outputting a signal from the calculating unit may be further disposed on the support frame.

When the active actuator and the manual actuator are stopped, a person who needs rehabilitation may exercise by fixing an upper limb to the upper limb connector of the link unit and moving the upper limb.

When the active actuator is supplied with power and operated, the active actuator may rotate the connecting shaft unit with an upper limb of a person who needs rehabilitation fixed to the upper limb connector of the link unit, so the link unit may move along an exercise path and the upper limb of the person who needs rehabilitation may be moved and exercised.

When the active actuator is stopped and the manual actuator is operated, a person who needs rehabilitation may exercise by fixing an upper limb to the upper limb connector of the link unit and moving the upper limb.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Hereinafter, exemplary embodiments of the present invention are described in detail with reference to the accompanying drawings.

Figure 1:
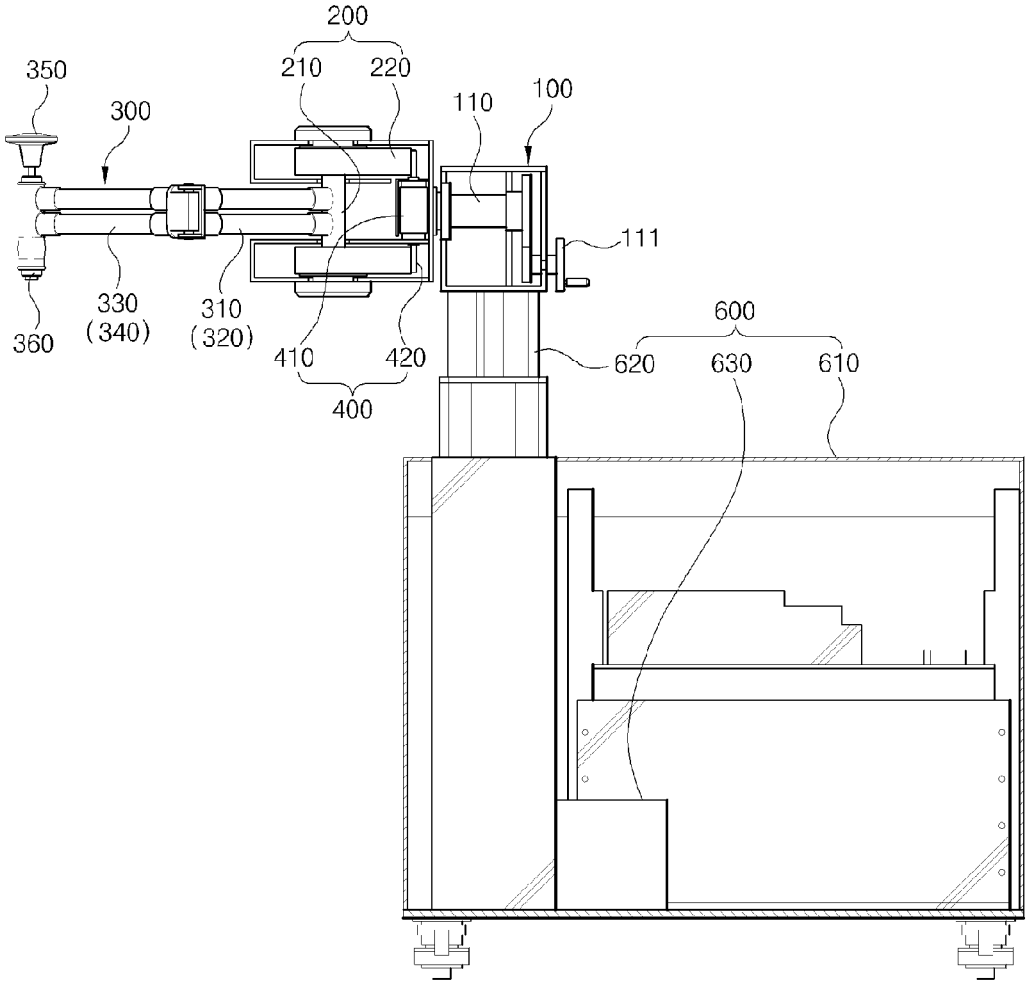
FIG. 1 is a cross-sectional view illustrating an entire upper limb rehabilitation robot according to an embodiment of the present invention.
Figure 2:
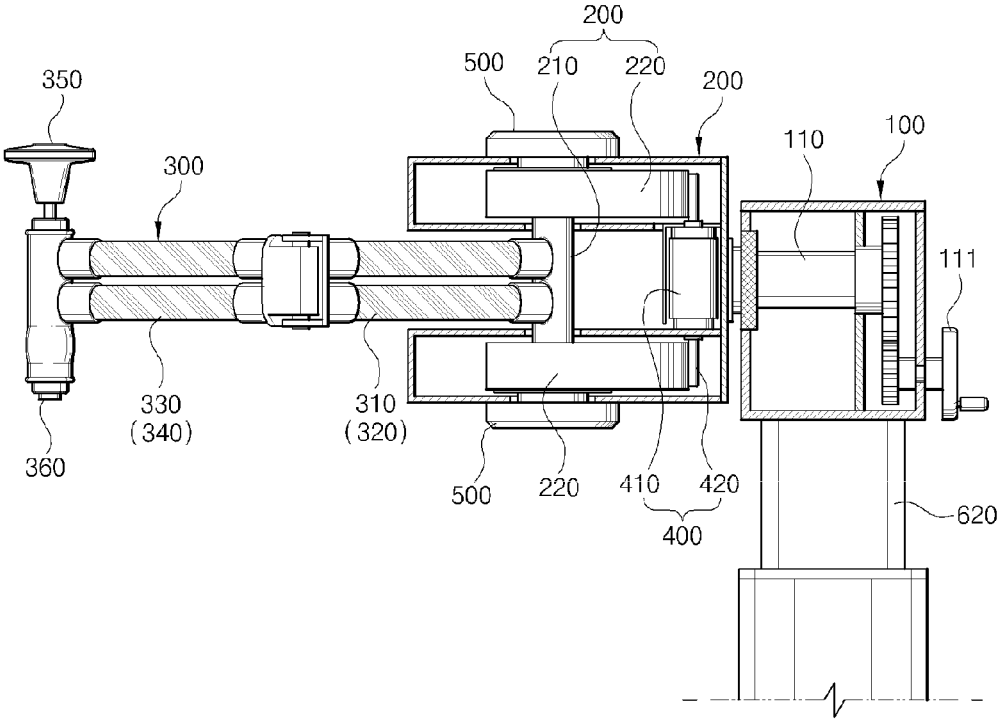
FIG. 2 is a partial enlarged view of FIG. 1.
Figure 3:
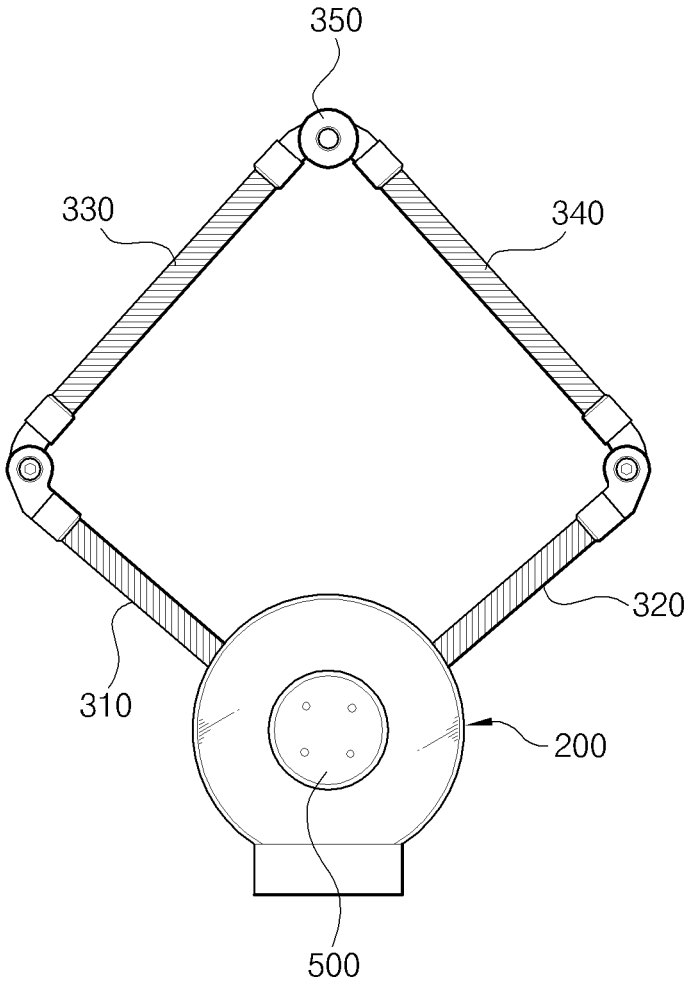
FIG. 3 is a plan view of FIG. 2.

FIG. 1 is a cross-sectional view illustrating an entire upper limb rehabilitation robot according to an embodiment of the present invention, FIG. 2 is a partial enlarged view of FIG. 1, and FIG. 3 is a plan view of FIG. 2. Referring to FIGS. 1 to 3, the upper limb rehabilitation robot includes a base frame 100, a connecting shaft unit 200, a link unit 300, an active actuator 400, and a manual actuator 500.

The base frame 100 is a part connecting and supporting the connecting shaft unit 200, the link unit 300, the active actuator 400, and the manual actuator 500. Although the base frame 100 illustrated in the figures have a rectangular barrel shape with an inner space, it is not limited thereto and may be formed in the shapes of barrels other than the rectangular barrel or various shapes of blocks without an inner space.

A connecting support 110 is laterally disposed at aside of the base frame 100. That is, one end of the connecting support 110 is rotatably connected to a side of the base frame 100. A bearing member (not illustrated) may be disposed at the portion of the base frame 100 where one end of the connecting support 110 is connected, to connect and support one end of the connecting support 110 so that it can easily rotate.

A rotary handle 111 that is held by a hand and enables the connecting support 110 to easily rotate on the base frame 100 may be coupled to one end of the connecting support 110. A positioning motor (not illustrated) may be connected to the connecting support 110 so that the connecting support 110 can be rotated by torque generated by electricity other than a driving force applied by a hand holding and rotating the rotary handle 111. That is, the rotary shaft of the positioning motor is connected with an end of the connecting support 110 through a gear member (not illustrated) and transmits torque to the connecting support 110, thereby rotating the connecting support 110.

The connecting shaft unit 200 connects the link unit 300, which will be described below, to the connecting support 110. The connecting shaft unit 200 is rotatably connected to a side of the connecting support 110, in detail, a side of the other end of the connecting support 110. The connecting shaft unit 200 includes a shaft body 210 and rotary connecting members 220.

The shaft body 210 is a rod-shaped member rotatably connected to the other end of the connecting support 110. That is, the shaft body 210 is rotatably longitudinally connected to a side of the other end of the connecting support 110. A side of the link unit 300 that will be described below is connected to the shaft body 210, so the link unit 300 operates with rotation of the shaft body 210. That is, the link unit 300 operates with rotation of the shaft body 210 and the shaft body 210 also rotates with operation of the link unit 300.

The rotary connecting members 220 connect the shaft body 210 with the active actuator 400 that will be described below. That is, the rotary connecting members 220 transmit torque generated by the active actuator 400 to the shaft body 210. The rotary connecting members 220 have a disc shape and are fixed to a side of the shaft body 210 and connected with the active actuator 400. Teeth (not illustrated) may be formed around the outer sides of the rotary connecting members 220 so that the rotary connecting members can be engaged with the active actuator 400.

The link unit 300 is a part connecting the connecting shaft unit 200 with an upper limb of a person who needs rehabilitation. That is, the link unit 300 rotates about the connecting shaft unit 200, connecting and supporting an upper limb to be rehabilitated of a person who needs rehabilitation. Accordingly, the link unit 300 supports an upper limb of a person who needs rehabilitation so that he/she swings his/her upper limb. A side of the link unit 300 is connected to the shaft body 210 of the connecting shaft unit 200 rotatably connected to the connecting support 110 and the other side supports an upper limb of a person who needs rehabilitation. The link unit 300 includes a first rod 310, a second rod 320, a third rod 330, a fourth rod 340, and an upper limb connector 350.

A longitudinal end of each of the first rod 310 and the second rod 320 is coupled to the shaft body 210 of the connecting shaft unit 200. One longitudinal end of the first rod 310 is fixed to the shaft body 210 of the connecting shaft unit 200 and moves with rotation of the shaft body 210 by the active actuator 400 that will be described below. On the contrary, the shaft body 210 also can rotate with a motion of the first rod 310. A longitudinal end of the second rod 320 is rotatably coupled to the outer side of the shaft body 210 of the connecting shaft unit 200. That is, the second rod 320 does not move even though the shaft body 210 rotates. On the contrary, the shaft body 210 also does not rotate even though the first rod 310 moves.

A longitudinal end of each of the third rod 330 and the fourth rod 340 is connected to the first rod 310 and the second rod 320 and the other longitudinal ends are rotatably connected to each other. That is, a longitudinal end of the third rod 330 is rotatably coupled to the other longitudinal end of the first rod 310 by a pin. That is, a longitudinal end of the fourth rod 340 is rotatably coupled to the other longitudinal end of the second rod 320 by a pin. Further, the other longitudinal end of the third rod 330 and the other longitudinal end of the fourth rod 340 are rotatably coupled to each other by a pin.

Figure 4A:
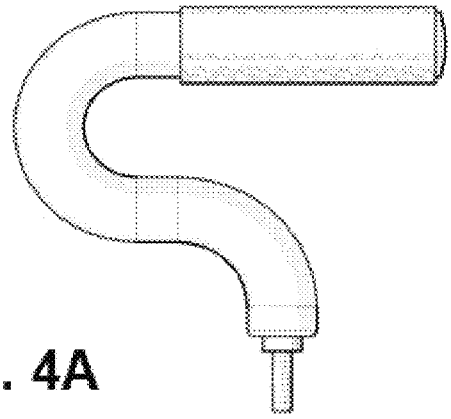
FIGS. 4A to 4C are cross-sectional views illustrating other embodiments of the upper limb connector illustrated in FIG. 2.
Figure 4B:
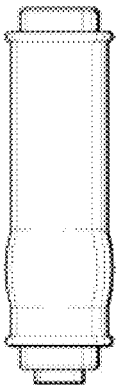
Figure 4C:
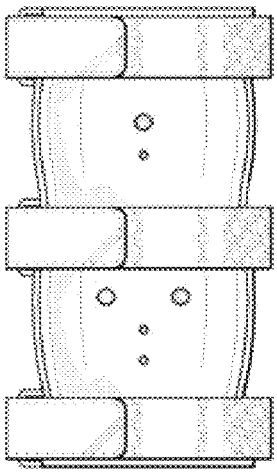

The upper limb connector 350 enables an upper limb of a person who needs rehabilitation to be connected. The upper limb connector 350 is coupled to the other side of the link unit 300, in detail, the joint of the other longitudinal end of the third rod 330 and the other longitudinal end of the fourth rod 340. Although the upper limb connector 350 is illustrated as a handle bar that a person who needs rehabilitation holds with a hand to easily move the first rod 310, the second rod 320, the third rod 330, and the fourth rod 340, it is not limited thereto and may be handle bars having various shapes, as illustrated in FIGS. 4A and 4B or a wrist support fixing and supporting an upper limb, in detail, a wrist of a person who needs rehabilitation, as illustrated in FIG. 4C.

A ball plunger 360 that supports an upper limb of a person who needs rehabilitation to be able to move on the bottom of the other side of the link unit 300 may be coupled to the other side of the link unit 300. The ball plunger 360 is coupled to the lower portion of the other side of the link unit 300, in detail, the joint of the other longitudinal end of the third rod 330 and the other longitudinal end of the fourth rod 340.

The active actuator 400 generates a driving force to move an upper limb of a person who needs rehabilitation supported on the upper limb connector 350 of the link unit 300.

That is, the active actuator 400 generates a driving force to rotate the shaft body 210 of the connecting shaft unit 200 clockwise or counterclockwise, so the link 300 moves with rotation of the shaft body 210 and exercises an upper limb of a person who needs rehabilitation. The active actuator 400 is fixed to a side of the connecting support 110 of the base frame 100 and connected with the connecting shaft unit 200. The active actuator 400 includes a driving motor 410 and a transmitting member 420.

The driving motor 410 operates to generate torque, using power from the outside. The driving motor 410 is fixed to a side of the connecting support 110 of the base frame 100.

The transmitting member 420 transmits torque generated by the driving motor 410 to the shaft body 210 of the connecting shaft unit 200. The transmitting unit 420 connects a driving shaft of the driving motor 410 with the rotary connecting members 220 of the connecting shaft unit 200. Although the transmitting member 420 is illustrated as a gear-like part fixed to a side of the driving shaft of the driving motor 410, in contact with the outer sides of the rotary connecting members 220 of the connecting shaft unit 200, it is not limited thereto and may be connected by a chain-belt structure of a cable power transmission structure.

The manual actuator 500 generates resistant torque against rotation of a person who needs rehabilitation with respect to the shaft body 210 of the connecting shaft unit 200 that is rotated by operation of the link unit 300, so it increase resistance against a motion of a person who needs rehabilitation and holds the link unit 300, thereby increasing exercise effect. That is, the manual actuator 500 selectively generates resistant torque against rotation about the shaft body 210 of the connecting shaft unit 200 only when it is operated by power, without the connecting shaft unit 200 rotated by the active actuator 400. The manual actuator 500 is connected to the shaft body 210 of the connecting shaft unit 200. Although the manual actuator 500 is illustrated as a variable damper disposed on the connecting support 110, with its shank inserted in the shaft body 210 of the connecting shaft unit 200, but it is not limited thereto and a brake member generating resistant torque against rotation of the shaft body 210 may be used. When the manual actuator 500 is a variable damper, one of an electrorheological fluid damper, a magnetorheological fluid damper, and a magnetic damper that can adjust a damping coefficient, using electric or magnetic features, may be selectively used.

The upper limb rehabilitation robot according to an embodiment may include a lifter 600 that allows for adjustment of a vertical position by vertically moving the base frame 100 so that a person who needs rehabilitation can stably place an upper limb. The lifter 600 is connected to the base frame 100 and includes a support frame 610, a lifting guide bar 620, and a lifting unit 630.

The support frame 610 is disposed under the base frame 100. That is, the support frame 610 connects and supports the base frame 100. Although the support frame 610 is shown as a rectangular barrel, it is not limited thereto.

The lifting guide bar 620 is connected to a side of the support frame 610 to be able to vertically slide. Although the lifting guide bar 620 is shown as a rectangular rod, it is not limited thereto and may be formed in the shape of a circular rod or the shapes of polygon rods other than a rectangle. The lifting guide bar 620 is vertically disposed at a side of the support frame 610. The base frame 100 is coupled to a side of the lifting guide bar 620, in detail, the top of the lifting guide bar 620.

The lifting unit 630 generates a driving force for vertically moving the lifting guide bar 620 on the support frame 610. The lifting unit 630 is coupled to a side of the support frame 610 and connected to a side of the bottom of the lifting guide bar 620. The lifting unit 630 may be selectively equipped with a motor, but it is not limited thereto and may be selectively equipped with a cylinder. When the lifting unit 630 is equipped with a motor, a pinion is fitted on a shaft of the motor and a rack gear is fitted on the lifting guide bar 620, so as the lifting guide bar 620 moves up/down in accordance with the rotational direction of the shaft of the motor.

Further, a calculating unit (not illustrated) and a driving control unit (not illustrated), which are electrically connected with the active actuator 400 and the manual actuator 500, analyze and process data obtained from the driving motor 410 of the active actuator 400 and the variable damper of the manual actuator 500, quantify the path, direction, and speed of a motion, and control the operation of the driving motor 410 of the active actuator 400 and the variable damper of the manual actuator 500, may be disposed on the support frame 610. Further, a display unit, which is electrically connected with the calculating unit, visually provides a person, who needs rehabilitation with a task to do for rehabilitation, and receives and outputs signals corresponding to the path, direction, and speed of a motion quantified by the calculating unit, may be disposed on the support frame 610.

Rehabilitation operation of the upper limb rehabilitation robot having the configuration according to an embodiment is described with reference to FIGS. 1 to 4C.

First, when the active actuator 400 and the manual actuator 500 are not operated, a person who needs rehabilitation can exercise by moving an upper limb while holding the upper limb connector 350 of the link unit 300 or fixing the upper limb to the upper limb connector. When the link unit 300 is maintained horizontally, horizontal exercise is possible, and when the connecting support 110 is turned and the link unit 300 is positioned at an angle or vertically, inclined exercise or vertical exercise is possible.

When power is supplied to the active actuator 400 and automatic exercise is performed by the active actuator 400, the active actuator 400 rotates the shaft body 210 of the connecting shaft unit 200, with a person who needs rehabilitation holding the upper limb connector 350 of the link unit 300 or fixing an upper limb to the upper limb connector. Accordingly, as the shaft body 210 rotates, the link unit 300 moves along an exercise path, and thus, the upper limb of a person who needs rehabilitation is moved and exercised.

Alternatively, when the active actuator 400 is not operated and the manual actuator 500 is operated, a person who needs rehabilitation can exercise by moving an upper limb while holding the upper limb connector 350 of the link unit 300 or fixing the upper limb to the upper limb connector. The manual actuator 500 generates resistant torque against rotation of the shaft body 210 while the damper value changes in accordance with an input voltage, so the person who needs rehabilitation can exercise against the resistance generated by the manual actuator 500. As described above, when the link unit 300 is maintained horizontally, horizontal exercise is possible, and when the connecting support 110 is turned and the link unit 300 is positioned at an angle or vertically, inclined exercise or vertical exercise is possible.

According to the upper limb rehabilitation robot of an embodiment, the connecting shaft unit 200 is rotatably disposed on the connecting support 110 of the base frame 100 and a person who needs rehabilitation exercise with an upper limb at the other side of the link unit 300, with one side of the link unit 300 connected to the connecting shaft unit 200. As the person who needs rehabilitation moves the link unit 300 along the exercise path, he/she can perform horizontal exercise, inclined exercise, and vertical exercise, by changing the position of the link unit 300 horizontally, at an angle, and vertically. Further the person can selectively perform active exercise, manual exercise, and resistant exercise in accordance with whether the active actuator 400 and the manual actuator 500 operate.

As set forth above, according to exemplary embodiments of the invention, the connecting shaft unit is rotatably disposed on the connecting support of the base frame and a person who needs rehabilitation exercise with an upper limb at the other side of the link unit, with one side of the link unit connected to the connecting shaft unit. As the person who needs rehabilitation moves the link unit along the exercise path, he/she can perform horizontal exercise, inclined exercise, and vertical exercise, by changing the position of the link unit horizontally, at an angle, and vertically. Further the person can selectively perform active exercise, manual exercise, and resistant exercise in accordance with whether the active actuator and the manual actuator operate.

While the present invention has been shown and described in connection with the exemplary embodiments, it will be apparent to those skilled in the art that modifications and variations can be made without departing from the spirit and scope of the invention as defined by the appended claims.

What is claimed is:

1. An upper limb rehabilitation robot comprising:

a base frame that has a side to which a connecting support is laterally connected;

a connecting shaft unit that is rotatably disposed at a side of the connecting support;

a link unit that has a side coupled to the connecting shaft unit and an other side with an upper limb connector adapted to be connected to an upper limb of a person who needs rehabilitation;

an active actuator that is disposed at the side of the connecting support, connected with the connecting shaft unit, and rotates the connecting shaft unit; and a manual actuator that is connected to the connecting shaft unit and generates resistant torque against rotation of the connecting shaft unit; wherein the link unit includes:

a first rod fixed to the connecting shaft unit;

a second rod with an end rotatably coupled to the connecting shaft unit;

a third rod with a side rotatably coupled to an other side of the first rod by a pin; and a fourth rod with both ends rotatably coupled to an other end of the second rod and an other end of the third rod by a pin, respectively, and the upper limb connector is coupled to a joint of the third rod and the fourth rod.

2. The upper limp rehabilitation robot of claim 1, wherein the connecting shaft unit includes:

a shaft body that is rotatably longitudinally connected to the side of the connecting support; and two rotary connecting members that are coupled to the shaft body, connected with the active actuator, and receive torque from the active actuator, wherein each of the two rotary connecting members is coupled to opposite side of the shaft body respectively.

3. The upper limp rehabilitation robot of claim 1, wherein the link unit further has a ball plunger supporting an other side of the link unit and the ball plunger is coupled to the joint of the third rod and the fourth rod.

4. The upper limp rehabilitation robot of claim 1, wherein the active actuator includes:

a driving motor coupled to the side of the connecting support; and a transmitting member coupled to a driving shaft of the driving motor, connected with the connecting shaft unit, and transmitting torque generated by the driving motor to the connecting shaft unit.

5. The upper limp rehabilitation robot of claim 1, wherein the manual actuator is a variable damper that is disposed on the connecting shaft unit, with a shank inserted in the connecting shaft unit, and generates resistant torque against torque of the connecting shaft unit.

6. The upper limp rehabilitation robot of claim 1, further comprising a lifter moving up/down the base frame.

7. The upper limp rehabilitation robot of claim 6, wherein the lifter includes:

a support frame;

a lifting guide bar that is disposed vertically on the support frame, slides up/down, and has a side connected with the base frame; and a lifting unit that is disposed on the support frame, connected with the lifting guide bar, and generates a driving force for moving up/down the lifting guide bar on the support frame.

8. The upper limb rehabilitation robot of claim 1, wherein when the active actuator and the manual actuator are stopped, the upper limb connector of the link unit is adapted to be fixed to the upper limb of the person who needs rehabilitation exercises for moving the upper limb.

9. The upper limb rehabilitation robot of claim 1, wherein when the active actuator is supplied with power and operated, the active actuator rotates the connecting shaft unit with the upper limb connector of the link unit adapted to be fixed to the upper limb of the person who needs rehabilitation exercises, so the link unit moves along an exercise path and the upper limb of the person who needs rehabilitation is moved and exercised.

10. The upper limb rehabilitation robot of claim 1, wherein when the active actuator is stopped and the manual actuator is operated, the upper limb connector of the link unit is adapted to be fixed to the upper limb of the person who needs rehabilitation exercises for moving the upper limb.

11. The upper limp rehabilitation robot of claim 2, further comprising a lifter moving up/down the base frame.

12. The upper limp rehabilitation robot of claim 3, further comprising a lifter moving up/down the base frame.

13. The upper limp rehabilitation robot of claim 4, further comprising a lifter moving up/down the base frame.

14. The upper limp rehabilitation robot of claim 5, further comprising a lifter moving up/down the base frame.

* * * * *